US006567642B2

(12) United States Patent
Marsh

(10) Patent No.: US 6,567,642 B2
(45) Date of Patent: May 20, 2003

(54) HYBRID THERMAL TRANSFER ROLLER BRUSH WAX APPLICATOR FOR RUB-OFF REDUCTION

(75) Inventor: Dana G. Marsh, Newark, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/190,763

(22) Filed: Jul. 8, 2002

(65) Prior Publication Data

US 2003/0031487 A1 Feb. 13, 2003

Related U.S. Application Data

(60) Provisional application No. 60/310,879, filed on Aug. 8, 2001.

(51) Int. Cl.[7] ..... G03G 15/20
(52) U.S. Cl. ..... 399/341; 399/325
(58) Field of Search ..... 399/324, 325, 399/341; 430/124

(56) References Cited

U.S. PATENT DOCUMENTS 3,653,932 A 4/1972 Berry et al.
3,715,219 A 2/1973 Kurz et al.
3,984,809 A 10/1976 Dertouzos et al.
4,250,511 A 2/1981 Stein et al.
4,390,369 A 6/1983 Merritt et al.
4,447,818 A 5/1984 Kurata et al.
4,458,253 A 7/1984 Goff, Jr. et al.
4,484,948 A 11/1984 Merritt et al.
4,490,731 A 12/1984 Vaught
4,568,949 A 2/1986 Muranaka
4,659,383 A 4/1987 Lin et al.
4,666,757 A 5/1987 Helinski
4,721,635 A 1/1988 Helinski
4,745,420 A 5/1988 Gerstenmaier (List continued on next page.)

*Primary Examiner*—Hoang Ngo

(57) ABSTRACT

A method for reducing rub-off from a substrate having a front side and a back side with at least one side bearing a toner image by depositing a substantially clear phase change composition onto a rotary brush in contact with the substrate using a ribbon or diffusion process printer with the phase change composition being transferred from the brush to the substrate in an amount sufficient to reduce rub-off from the side of the substrate bearing a toner image. The printer and a second rotary brush may be also used to deposit a clear phase change composition onto a non-image bearing back-side of the substrate.

22 Claims, 3 Drawing Sheets

U.S. PATENT DOCUMENTS 4,851,045 A 7/1989 Taniguchi
4,889,560 A 12/1989 Jaeger et al.
5,006,170 A 4/1991 Schwaz et al.
5,092,235 A 3/1992 Rise
5,151,120 A 9/1992 You et al.
5,182,572 A 1/1993 Merritt et al.
5,185,035 A 2/1993 Brown et al.
5,372,852 A 12/1994 Titterington et al.
5,389,958 A 2/1995 Bui et al.
5,495,270 A 2/1996 Burr et al.
5,541,624 A 7/1996 Cooke et al.
5,569,540 A 10/1996 Hirose et al.
5,598,195 A 1/1997 Okamoto et al.
5,672,413 A 9/1997 Taylor et al.
5,802,440 A * 9/1998 Maeyama ..... 399/327
5,827,918 A 10/1998 Titterington et al.
5,830,942 A 11/1998 King et al.
5,875,381 A * 2/1999 Moser ..... 399/324
5,879,790 A 3/1999 Sogabe et al.
5,922,114 A 7/1999 Sawada
5,954,865 A 9/1999 Sawada
5,958,169 A 9/1999 Titterington et al.
5,966,150 A 10/1999 Lester et al.
5,980,621 A 11/1999 Inaishi et al.
5,994,453 A 11/1999 Banning et al.
6,015,847 A 1/2000 Titterington et al.
6,018,005 A 1/2000 Banning et al.
6,022,910 A 2/2000 Nishizaki et al.
6,028,138 A 2/2000 Hahn et al.
6,037,396 A 3/2000 Sawada
6,048,925 A 4/2000 Titterington et al.
6,057,385 A 5/2000 Syutara et al.
6,063,729 A 5/2000 Eguchi et al.

* cited by examiner

HYBRID THERMAL TRANSFER ROLLER BRUSH WAX APPLICATOR FOR RUB-OFF REDUCTION

This application is entitled to and hereby claims the benefit of U.S. provisional application Serial No. 60/310,879 filed Aug. 8, 2001.

FIELD OF THE INVENTION

Related Applications

This invention relates to a method for reducing rub-off from a substrate, such as paper, having a toner image on at least one side of the substrate by depositing a quantity of a substantially clear phase change composition on the side of the substrate bearing the image in an amount sufficient to reduce rub-off from the substrate by depositing the phase change composition with a ribbon printer or a diffusion process printer onto a rotary brush in contact with the image side of the substrate to deposit the phase change composition on the image side of the substrate in an amount sufficient to reduce rub-off from the substrate.

BACKGROUND OF THE INVENTION

In electrophotographic printing, digital copying, and copying processes, images are formed on selected substrates, typically paper, using small, dry, colored particles called toner. Toner usually comprises a thermoplastic resin binder, dye or pigment colorants, charge control additives, cleaning aids, fuser release additives and optionally, flow control and tribocharging control surface treatment additives.

The thermoplastic toner is typically attached to a print substrate by a combination of heating and pressure using a fusing subassembly that partially melts the toner into the paper fibers at the surface of the paper substrate. Additionally, the fused toner image surface finish can be controlled by the surface finish on the surface of the fuser roller. Thus, the gloss of the image may be controlled between diffuse (low gloss) and specular (high gloss). If the surface finish of the image is rough (diffuse) then light is scattered and image gloss is reduced.

Typically, in an electrophotographic printer, a heated fuser roller is used with a pressure roller to attach toner to a receiver and to control the image surface characteristics. Heat is typically applied to the fusing rollers by a resistance heater such as a halogen lamp. Heat can be applied to the inside of at least one hollow roller, and/or to the surface of at least one roller. At least one of the rollers is typically compliant. When the rollers of a heated roller fusing assembly are pressed together under pressure, the compliant roller deflects to form a fusing nip. Most heat transfer between the surface of the fusing roller and the toner occurs in the fusing nip. In order to minimize "offset," which is the amount of toner that adheres to the surface of the fuser roller, release oil is typically applied to the surface of the fuser roller via a wick roller. Typically, the release oil is silicone oil plus additives that improve attachment of the release oil to the surface of the fuser roller, and dissipate static charge buildup on the fuser rollers or fused prints. Some of the release oil becomes attached to the image and background areas of the fused prints.

Fused toner images can be substantially abraded or "rubbed-off" by processes such as duplex imaging, folding, sorting, stapling, binding, filing and the like. Residue from this abrasion process causes objectionable and undesirable marks on non-imaged areas of adjacent pages or covers. This process, and image quality defect, are known as "rub-off" and exist to varying extents in many electrophotographic copies and prints. The basic "requirements" for generation of rub-off are a donor (toner image), a receptor (adjacent paper page, envelope, mailing label, etc.), a differential velocity between donor and receptor, and a load between donor and receptor.

In general, mechanisms of rub-off are consistent with those of abrasive and adhesive wear mechanisms. Relevant factors include: toner toughness, toner brittleness (cross-linking density), surface energy or coefficient of friction of the toner, adhesion of the toner to the paper substrate, cohesive properties of the toner itself, the surface topography of the toner image, the level of load and the differential velocities of the wearing surfaces. Some of these factors are under the control of the machine and materials manufacturers, and some are under the control of the end user.

Toner rub-off may be reduced by the use of tougher toner, lower surface energy toner materials (resulting in lower coefficient of friction), better-fused toner, and a smoother toner image surface finish (but this increases image gloss.)

Unfortunately, there are undesirable consequences associated with each of the above rub-off reduction factors. A tougher toner is more difficult to pulverize, grind, and classify which increases manufacturing costs. Additionally, smaller toner particle size distributions are more difficult to achieve with tougher toner. Adding wax to the toner may provide additional release properties from the fuser roller surface, and add lubrication to the surface of the toner, but triboelectric charging behavior may be adversely affected. A more easily fusible toner may create more toner offset to the surface of the fuser rollers, or increase the tendency of fused prints or copies to stick together in the finisher or output trays. Creating a more specular (smoother) image surface finish increases image gloss, which may be objectionable in some applications. Fuser release oil can lower the coefficient of friction of the fused image, but this effect is temporary since the oil is adsorbed into the paper substrate over time. Fuser release oil can also cause undesirable effects in the rest of the electrophotographic process, especially in duplex printing operations.

SUMMARY OF THE INVENTION

Extensive efforts have been directed to the development of improved methods for reducing rub-off without modification of the fusing process.

According to the present invention, rub-off from a substrate having a front and back side with a toner image on at least one side is reduced by a method comprising: positioning a rotary brush in contact with the side of the substrate bearing the toner image; depositing a quantity of a phase change composition on the rotary brush using a ribbon or diffusion process printer; and, rotating the rotary brush to transfer a quantity of the phase change composition to the side of the substrate bearing the toner image, the quantity being an amount sufficient to reduce rub-off from the side of the substrate bearing the toner image. For the sake of future convenience, the invention will be discussed with respect to having an image on one side only, but it is to be understood that the substrate may bear images on both sides.

DESCRIPTION OF THE PREFERRED EMBODIMENTS

Figure 1:
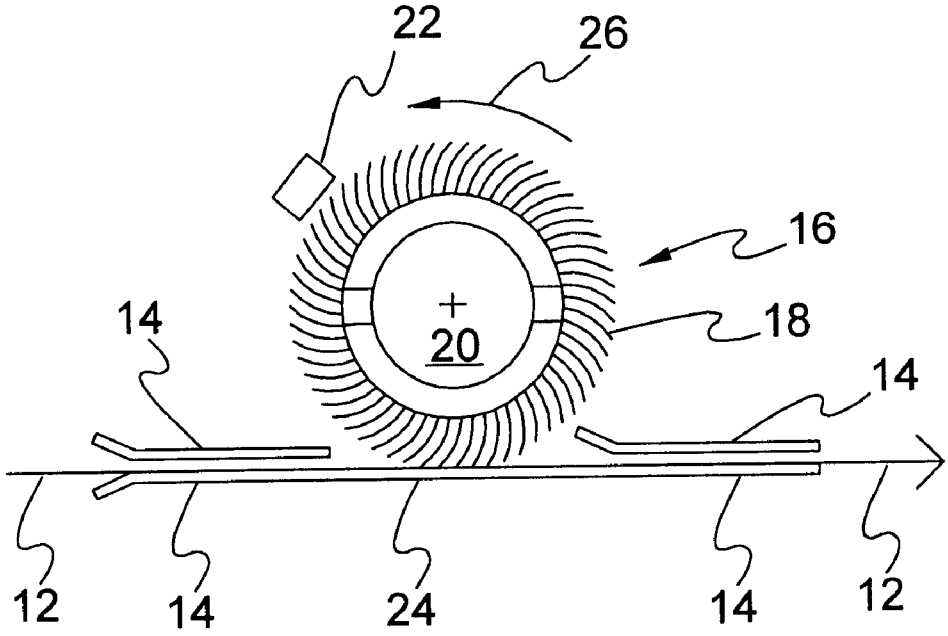
FIG. 1 shows a schematic embodiment of the present invention.

Many electrophotographic processes produce prints or copies, which have a high rub-off of toner onto adjacent receiver sheets that is considered unacceptable by some users. The amount of rub-off depends upon the particular machine hardware, oiling rates and the like. Typical values from 19 to 25 are measured at 3 psi (pounds per square inch) using the test procedure described herein for copies that have been aged for about 100 hours.

The existing toners in some instances do not have a wax lubricant and offer little protection against rub-off. The electrophotographic process typically forms images on selected substrates, which are typically paper, using small, dry, colored particles called toner. Toners usually comprise a thermoplastic resin binder, dye or pigment colorants, charge control additives, cleaning aids, fuser release additives and, optionally, flow control and tribocharging control surface treatment additives.

The thermoplastic toner is typically attached to a print substrate by a combination of heat and pressure using a fusing subassembly that partially melts the toner into the paper fibers at the surface of the paper substrate. The fused toner image surface finish is affected by the fuser roller surface finish. Thus, the gloss of the image may be controlled between diffuse (low gloss) and specular (high gloss). When the surface finish of the image is rough, the light is scattered and image gloss is reduced.

Typically in an electrophotographic printer a heated fuser roller is used with a pressure roller to attach toner to a receiver and to control the toner image surface characteristics. Heat is typically applied to the fusing rollers by a resistance heater such as a halogen lamp. Heat can be applied to the inside of at least one hollow roller, and/or to the surface of at least one roller. At least one of the rollers is typically compliant. When the rollers of a heated roller fusing assembly are pressed together under pressure, the compliant roller deflects to form a fusing nip. Most heat transfer between the surface of the fusing roller and the toner occurs in the fusing nip. In order to minimize "offset," which is the amount of toner that adheres to the surface of the fuser roller, release oil is typically applied to the surface of the fuser roller. Typically, the release oil is silicone oil plus additives that improve attachment of the release oil to the surface of the fuser roller, and dissipate static charge buildup on the fuser rollers or fused prints. Some of the release oil becomes attached to the image and background areas of the fused prints.

Hot melt type inks, also referred to as phase change inks, typically comprise a carrier such as a polymeric or wax material and a colorant. Such phase change composition systems are known to those skilled in the art.

Many suitable carrier materials are known for phase change inks. When the colorant is omitted from these materials, they basically comprise a carrier for the colorant, without the colorant. Many of these materials are substantially colorless.

Ribbon printers and thermal diffusion printing systems typically provide the capability of providing a resolution of about 300 or more dpi (dots per inch). When printing a square matrix with such printers, it is possible to print with a resolution equal to 300 dpi in both a cross-track and an in-track direction. This produces a square of print dots referred to as a matrix, which contains the potential for 300 dpi along each axis. This resolution provides excellent print quality. Ribbon printers and thermal diffusion process printers having lesser resolutions of 50×300, 100×300, 200×0.300 dpi and the like are also available. Further, such print heads having a 300×300 resolution can be programmed to produce dots at a lesser cross-track frequency. Such printers produce single pixel ink drops, which are deposited onto the substrate where they instantly solidify. The single pixels are typically from about 12 to about 14 microns in height and form a dot which is typically about 83 microns in diameter and which typically contains about 80 nanograms of material per pixel. Such ink jet printers are considered to be well known to those skilled in the art and are readily available.

In the present invention, thermal transfer process technology, which is not susceptible to the disadvantages accompanying modification of the toner and the like, is used. In the present invention, phase change compositions, which contain no colorant and are substantially transparent, are used. The phase change composition dots are applied by a ribbon printer or a thermal diffusion printer. Ribbon printers comprise the use of hot melt thermal transfer sheets (ribbons) formed by coating a phase change composition on one side of a substrate film to form a sheet (ribbon), which is then used as a thermal transfer sheet (ribbon) for printing dots on the substrate bearing toner images. Such thermal transfer ribbons are well known to those skilled in the art.

In the present invention, a ribbon printer having a plurality of individually addressable thermal elements arranged in a cross-process direction in contact with a full width thermal transfer sheet bearing the phase composition material located in end-to-end relation across the process direction of motion of the substrate bearing the toner image is brought into contact with the substrate bearing the toner image and the thermal elements are selectively activated to deposit dots of the phase change composition in a desired amount on the substrate bearing the toner image. The thermal elements that are in direct contact with the thermal transfer sheet are activated to produce heat, which melts the wax. The carrier ribbon is positioned to extend across the width of the substrate bearing the toner image and is gradually advanced parallel to the substrate flow direction to provide new thermal transfer sheet as required for deposition of the dots by activation of the thermal elements. The thermal transfer sheet (ribbon) is in direct contact with the substrate surface in this embodiment. Desirably, the dots are deposited over a relatively limited area of the substrate bearing the toner image in an amount sufficient to reduce rub-off of the toner image on the substrate sheet, which is typically paper.

Accordingly, this thermal transfer print head (ribbon printer) functions by transferring phase change composition from the carrier sheet (ribbon) directly to the toner-bearing substrate, as the substrate is moved across the print head with the ribbon and the substrate being in a contact relationship. As a result of the direct contact, no aerosol sprays or wax or other resulting contamination on mechanical and electrical parts is anticipated.

An alternate process known as a thermal diffusion, dye diffusion or a dye sublimation process also uses a print head with a plurality of individually energizable heating elements and a carrier sheet (ribbon) bearing the phase change composition. In this diffusion process, intimate contact is not required but the ribbon is separated from the substrate by a small gap typically about 0.001 inch. In this instance, the thermal elements are activated to melt the wax and allow it to diffuse across the small gap. Laser scanning assemblies may also be used as a replacement for thermal print head technology for this application.

Both these technologies may be used for the direct application of wax onto preprinted pages or substrates. Also the phase change material may be applied only to the toner images on a page by selecting the proper laser scanner or print head elements which, when activated, deposit dots on the image. Both these processes result in substantially instant freezing of the droplets on the substrate or page and actual penetration of the droplets into the page is minimized. Accordingly, the droplets do not spread substantially after encountering a page. Therefore, multiple discrete areas of phase change composition may be applied as a predefined pattern of data onto the toner sheet.

Both these techniques are considered to be well known to those skilled in the art and no further discussion of these techniques is considered necessary. They are used in the present invention as known vehicles to deposit the droplets onto the substrate toner sheet to reduce rub-off in the inventive process.

Some systems of this type are shown in U.S. Pat. Nos. 3,984,809; 4,458,253; 4,568,949; 4,851,045; 5,879,790; and 6,057,385. These references are hereby incorporated in their entirety by reference.

Such phase change inks (hot melt inks) are desirable for ink jet, ribbon and diffusion printers because they remain in a solid state at room temperature during storage and shipment. In addition, problems associated with ink evaporation are eliminated and improved reliability of printing is achieved. When the drops of the hot melt ink are applied directly onto a substrate such as paper, the drops solidify immediately on contact with the substrate and migration of ink on the surface of the substrate is prevented.

Such hot melt waxes developed for full process color printing in graphics arts applications contain a wax vehicle, colorants, surfactants and dispersants to enable compatibility of the dye with anti-oxidants, cross-linking agents and the like. These waxes are also desirably modified to prevent crystallinity that will negatively impact the color hue.

Colorless hot melt waxes for use in rub-off reduction of electrophotographic toner images do not require surfactants, dispersants or dye. They may also contain slip agents, such as organic stearates, erucamide, stearyl amides, zinc stearates, lithium stearates and the like, to provide low surface energy properties to avoid offsetting of the wax material to receiver substrates. These waxes are preferentially crystalline to enable low gloss. Therefore, high melting waxes with sharp melting point ranges are desirable. Preferably, the waxes or other polymeric materials used have a melting point from about 80 to about 130° C. with a melting range (starts-to-melt to starts-to-freeze range) of about 15° C., and desirably about 10° C. Desirably these waxes or other polymeric materials are crystalline in solid form, have a low coefficient of friction and are odorless. Some suitable materials are waxes, polyethylene, polyalphaolefins, and polyolefins.

U.S. Pat. No. 5,958,169 discloses various hot wax compositions for use in ink jet printers. U.S. Pat. No. 6,018,005 discloses the use of urethane isocyanates, mono-amides, and polyethylene wax as hot melt wax compositions. The polyethylene is used at about 30 to about 80 percent by weight and preferably has a molecular weight between about 800 and about 1200.

U.S. Pat. No. 6,028,138 discloses phase change ink formulations using urethane isocyanate-derived resins, polyethylene wax, and a toughening agent. U.S. Pat. No. 6,048,925 discloses urethane isocyanate-derived resins for use in a phase change ink formulation. Both of these references disclose the use of a hydroxyl containing toughening agent.

Additional formulations are disclosed in U.S. Pat. Nos. 5,922,114; 5,954,865; 5,980,621; 6,022,910; and, 6,037,396.

U.S. Pat. No. 5,994,453 discloses phase change carrier compositions made by the combination of at least one urethane resin, at least one urethane/urea resin, at least one mono-amide and at least one polyethylene wax. This reference discloses further that the polyethylene may be employed as an overcoat on a printed substrate. The overcoat is supplied to protect from about 1 to about 25 percent of the surface area of the printed substrate. The treatment is disclosed to give enhanced anti-blocking properties to the prints and to provide enhanced document feeding performance of the ink-bearing substrates for subsequent operations, such as photocopying. This reference discloses the use of printing comprising images of phase change waxes, which are treated by overspraying the substrate bearing the images of phase change waxes. The reference does not address in any way the treatment of substrates bearing toner images. Toner images, as discussed above, are radically different than phase change ink images in their properties. Further, this reference does not address the reduction of rub-off of toner images.

All of the patents noted above are hereby incorporated in their entirety by reference.

According to the present invention, the rub-off of a toner image from a substrate having a front side and a back side and bearing a toner image on its front side, is reduced by positioning a rotary brush in contact with the front side of the substrate; depositing a quantity of phase change composition on the rotary brush using a ribbon or diffusion process printer; and, rotating the brush to transfer a quantity of the phase change composition to the front side of the substrate, the quantity of the phase change composition being an amount sufficient to reduce rub-off from the front side of the substrate.

The printer can be a conventional ribbon or diffusion process printer as known to those skilled in the art and configured to extend across the flow path of the paper or other substrate in the process. The printer is designed and positioned to deposit a desired quantity of phase change composition on a rotary brush. The rotary brush desirably comprises a core having bristles and is rotated in a direction so that the contact of the brush with the substrate, which is typically paper and referred to hereinafter as paper, is in the same direction as the paper movement through the process. Desirably, the rotary brush contacts the paper at a speed equal to from about 1 to about 3 times the speed of the paper movement and preferably from about 1.5 to about 2.5 times the speed of the paper movement. The brush typically contains finely divided bristles, which comprise a material such as nylon, polypropylene, conductive acrylic, conductive nylon, high-density polypropylene and mohair. Preferably, the bristles comprise nylon or polypropylene.

In FIG. 1, an embodiment of the present invention is shown. A paper path 12 is shown along which paper is moved through the process. Guides 14 are provided to direct the paper flow in the direction shown by line 12 and the arrow shown as the end of line 12. A brush 16 is positioned in engagement with the paper and comprises a core 20, which is used to mount the brush for rotation relative to paper path 12 as shown. Brush 16 includes bristles 18 which engage the paper. The direction of rotation of brush 16 is shown by arrow 26. Brush 16 typically contacts the paper against a support plate 24, which enables contact with the paper at a desired pressure. Desirably the contact pressure is from about 45 to about 95 grams per square centimeter based upon the area of contact between the brush and the paper. More desirably the contact pressure is from about 55 to 85 grams per square centimeter based upon the area of contact between the brush and paper. Most desirably, the contact pressure is from about 65 to 75 grams per square centimeter based upon the area of contact between the brush and paper.

According to the present invention, a clear phase change composition is applied to the brush by a ribbon or a diffusion process printer 22, which is schematically shown in contact with bristles 18, although as noted, the diffusion process printer is typically separated from the surface upon which it deposits material by a small gap. The printer is a conventional printer as known to those skilled in the art. Such printers deposit phase change compositions, which typically include a colorant when the printer is depositing an ink composition. When clear phase change compositions are used, they contain no colorant and are substantially colorless. Suitable phase change compositions have been described above.

Desirably, the printer extends across the width of the paper flow path. As well known to those skilled in the art, such printers can be programmed to deposit dots of phase change compositions at desired locations. Accordingly, the amount of phase change composition deposited on bristles 18 can be precisely controlled.

In many printers, digital copiers, and copiers it is desirable to be able to produce documents of various widths. Unfortunately, it is difficult to vary the length of brush 16 each time a different width of paper is produced. Accordingly, most copiers are designed to process paper up to 18 inches in width, as measured across the flow path. This width of paper corresponds to metric A3+ paper size. Therefore if phase change compositions are deposited across the entire length of brush 16 excessive phase change composition can build up on support plate 24 in the areas outside the paper. This difficulty is readily remedied by use of a ribbon or diffusion process printer which can be programmed to deposit material on only the length of brush 16 which contacts the paper moving along flow path 12.

Figure 2:
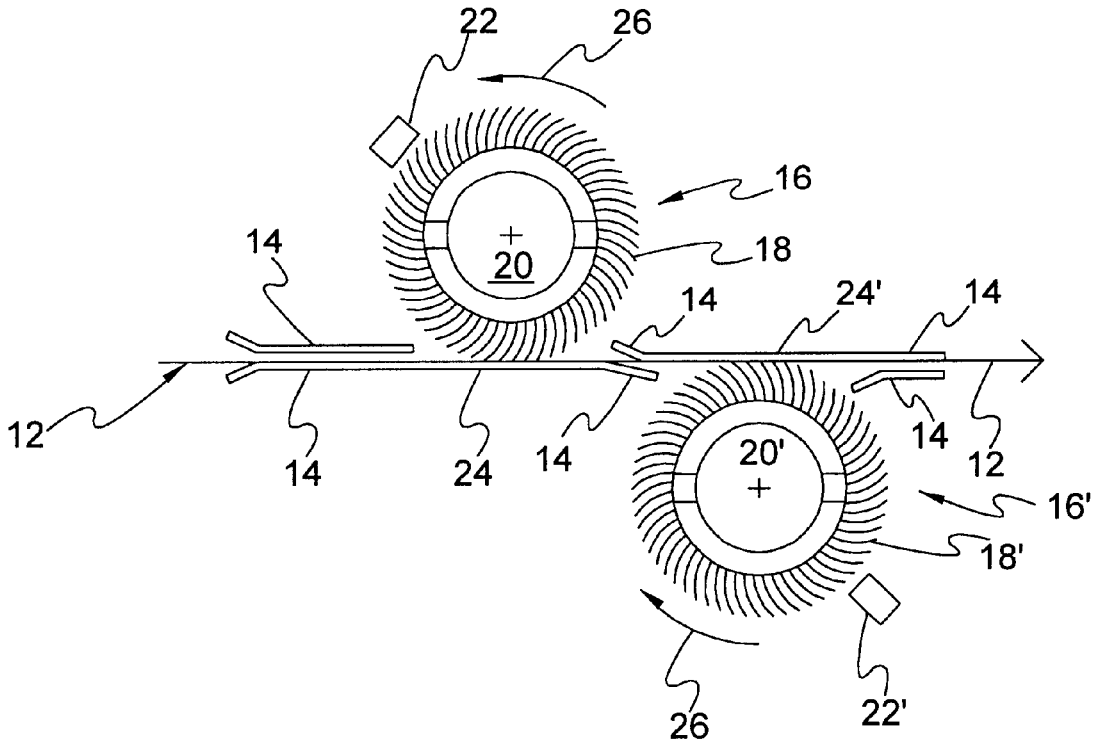
FIG. 2 is a schematic diagram of a further embodiment of the present invention; and, FIG. 3 is a schematic diagram of an alternative embodiment of the present invention.

In FIG. 2, an alternate embodiment of the present invention is shown. In this embodiment a second brush 16', which is comparable to the first brush 16, is used to coat a second side of the paper moving along flow path 12. In both instances a support plate is used and in both instances the phase change composition is deposited on the brush by a ribbon or diffusion process printer 22 or 22'.

Figure 3:
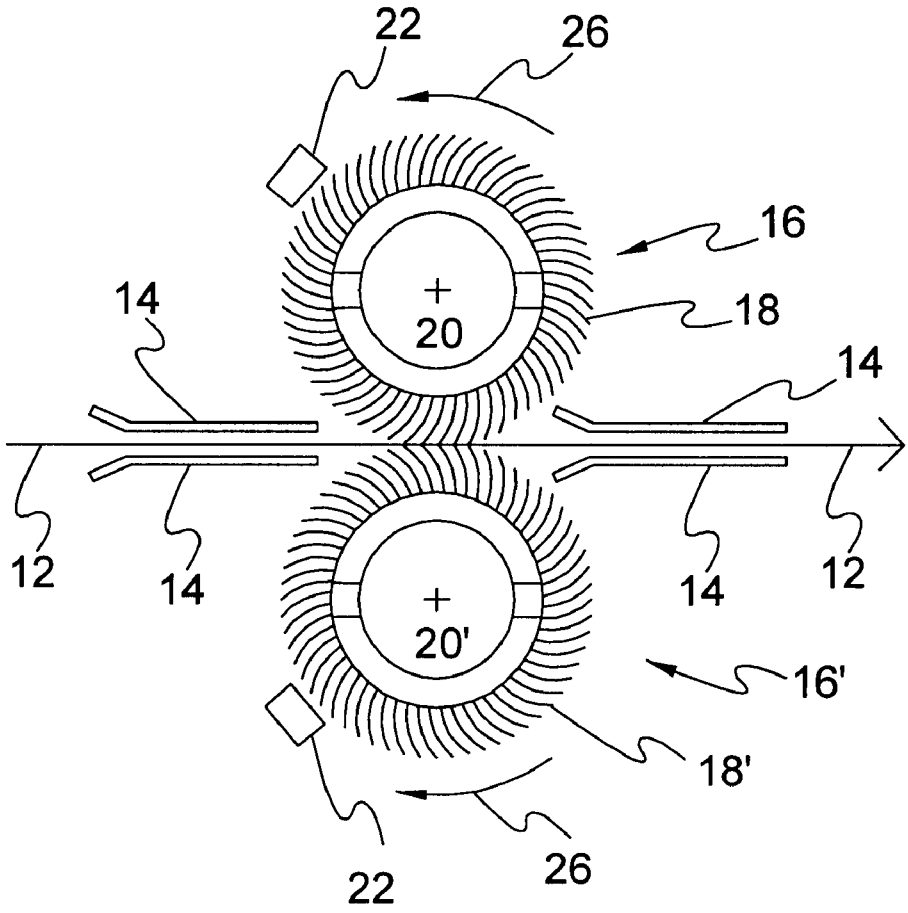

In FIG. 3, a further variation is shown where the paper passes between two rotary brushes with no support plate. In this instance, the brushes tend to support the paper in its flow along path 12 by contact with the sides of the paper. Accordingly, the present invention is useful to deposit phase change compositions on either or both sides of a substrate such as paper.

Desirably, an amount of the phase change composition sufficient to reduce the rub-off tendencies of the paper is supplied to the sides of the paper containing toner images. Typically, it has been found that from about 0.70 to about 7.0 milligrams of phase change composition are desirably deposited on an 8½ by 11 sheet of paper. Desirably, an amount of phase change composition is deposited sufficient to reduce the. rub-off of the toner image to a value from about 4 to about 6 as measured by the test procedure described hereinafter.

Typically, the phase change composition is selected from the group consisting of polymeric materials and waxes having a melting point from about 80 to about 130° C., a melting point range of less than about 15° C., a crystalline form as a solid, a static coefficient of friction less than about 0.62, and being substantially odorless. Desirably, the melting range is less than about 10° C. Typically, the phase change material comprises at least one component selected from the group consisting of waxes, polyethylene, polyalphaolefins, and polyolefins and may contain a friction reducing material as described above. The phase change composition is sufficiently hard as a solid on the ribbon that it is only removed from the ribbon in areas, which are heated. Most phase change compositions suitable for use in ink jet printers are also suitable for use in the present invention if they meet the physical requirements set forth above.

Typically, the toner image produced by an electrophotographic process may also be produced by digital printing or digital copying processes, which are effectively treated by the process of the present invention.

The substrate may have a toner image on both the front and the backside of the substrate. The phase change composition may be deposited on both sides of the substrate as discussed above. The most commonly used substrate is paper.

Test Procedure

The Test Procedure used basically involves the use of a selected weight positioned on top of a receiver sheet, which is a clean sheet of paper positioned above a toner image-bearing sheet positioned with an image—bearing side facing the receiver sheet. The toner image-bearing sheet is then slid a controlled distance under the weight on the upper sheet. The resulting discoloration of the upper sheet is then compared to a standard to produce a numeric indication of the degree of rub-off. The degree of rub-off from a clean sheet is 3.0. The rub-off of untreated toner image-bearing copies is typically from about 19 to about 25.

Typically, a standard test pattern is used to test the efficiency of the dot distribution. The test sheets used for the tests herein are referred to in the copying industry as Gutenberg sheets. These sheets are sheets of alternating very closely spaced lines of images of varying sizes. Desirably, a standard image of this type is used for all tests. The dots or other treatment applied is then readily evaluated for efficacy in reducing rub-off. As indicated above, the weight used for all tests in this application was 3 psi and the tests were performed by comparing all of the samples to the same set of standards to determine rub-off evaluation numbers.

Further, rubbed patches resulting from the tests were analyzed as follows:

(a) six rub-off patches were produced for each test. These test patches are first scanned on a calibrated scanner with the resulting scans or image being saved using a standard format;

(b) the patch image was then evaluated and a standard deviation of the density values from each patch is calculated. Applications such as Pro Shop or Math Cad can be used. It has been demonstrated that the results are identical. The standard deviation, so long as the mean density is below 0.30, has been shown to correlate with the subjective measures of the amount of toner on the sheets evaluated;

(c) the standard deviations of each patch were then averaged and the statistics provided for the test samples; and, (d) the average of the six standard deviations was reported as the rub-off value for any particular test.

The test sheets, as indicated, are sheets with densely spaced images across the surface of the paper. To avoid any tendency to form streaks in the test apparatus, the test sheet was turned to an angle of 7 (seven) degrees relative to the direction of movement relative to the top clean sheet. The 7-degree angle has been selected arbitrarily and can be any suitable angle so long as the printed sheet is turned to a sufficient extent to avoid a tendency to streak as a result of pulling the same letters of the sheet under the weighted area of the clean test sheet along the path of the test sheet. A suitable test method is disclosed in U.S. Patent application, U.S. Ser. No. 09/804,863 filed Mar. 13, 2001 by John Lawson, Gerard Darby, and Joe Basile, entitled "Rub-off Test Method and Apparatus".

It should be well understood that the use of the method of the present invention can be implemented by the use of a ribbon or diffusion process printer or the like to coat substrates bearing a toner image as they are produced in a printer or copier machine. The prints can be produced by analog photocopying processes or digitally, or the like. Further, the dot application system may be implemented as a part of the photocopier or printer machine, or as a stand-alone unit, which may apply rub-off reducing material in a separate step.

Many variations are possible within the scope of the present invention and many such variations may be considered obvious and desirable by those skilled in the art. For instance, a wide variety of wax and polymeric materials having the physical properties set forth above may be found effective. Further, it may be found desirable to imprint an indication of reduced rub-off treatment at the same time as the dots are applied in order to provide promotional labeling for treatment by the method of the present invention or it may be desirable to print colored images over a portion of the paper as the dots are applied. Such variations are considered to be well known to those skilled in the art.

As discussed previously, the development and use of a variety of polymeric and wax materials having suitable properties for use in ribbon or diffusion process printers for use as carriers for phase change inks and the like are well known. Many of these materials have been shown in patents referred to herein and in other patents available as open literature. Further, the use of ribbon printers and diffusion process printers is well known to those skilled in the art and a variety of such printers for applying dot images to paper are available on the open market.

Having disclosed the present invention by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon the foregoing description of preferred embodiments.

Having thus described the invention, I claim:

1. A method for reducing rub-off from a substrate having a front side and a back side and bearing a toner image on at least one side the method comprising:

(a) positioning a rotary brush in contact with the side of the substrate bearing the toner image.

(b) depositing a quantity of a phase change composition on the rotary brush using at least one of a ribbon printer and a diffusion process printer; and, (c) rotating the brush to transfer said quantity of the phase change composition to the side of the substrate bearing the toner image, the quantity being an amount sufficient to reduce rub-off from the side of the substrate bearing the toner image.

2. The method of claim 1 wherein the rotary brush is rotated in a direction so that the movement of its surface relative to the front side of the substrate is in the same direction as the movement of the substrate.

3. The method of claim 1 wherein the brush comprises a plurality of finely divided bristles.

4. The method of claim 3 wherein the bristles comprise at least one of nylon, polypropylene, conductive acrylic, conductive nylon, high density polypropylene and mohair.

5. The method of claim 4 wherein the bristles comprise nylon.

6. The method of claim 4 wherein the bristles comprise polypropylene.

7. The method of claim 4 wherein phase change composition comprises a blend of polymeric materials having a melting point from about 80 to about 130° C., a melting point range of less than about 15° C., a crystalline form as a solid, a static coefficient of friction less than about 0.62 and being substantially odorless as a solid.

8. The method of claim 7 wherein the phase change composition comprises a blend of waxes, polyethylene, polyalphaolefins and polyolefins.

9. The method of claim 8 wherein the phase change composition contains a lubricant selected from the group consisting of lithium stearate, zinc stearate, erucamide, stearyl amides and organic stearates.

10. The method of claim 9 wherein the static coefficient of friction is less than about 0.50.

11. The method of claim 1 wherein the brush engages the substrate with the substrate between the brush and a support plate.

12. The method of claim 1 wherein the brush is above the substrate.

13. The method of claim 1 wherein the brush is below the substrate.

14. The method of claim 1 wherein two brushes are used and wherein the substrate is engaged between the two brushes.

15. The method of claim 1 wherein the substrate is paper.

16. The method of claim 15 wherein the phase change composition is deposited on the side of the substrate bearing a toner image in an amount equal to about 0.7 to about 7.0 milligrams per sheet of paper.

17. The method of claim 2 wherein the brush surface in contact with the front surface of the substrate has a speed in the direction of the substrate movement equal to from about 1.5 to about 3.5 times the speed of the substrate.

18. The method of claim 1 wherein the phase change composition is deposited on the brush over a selected portion of the width of the brush.

19. The method of claim 1 wherein the phase change material is deposited on the middle eleven-inch portion of the brush.

20. The method of claim 1 wherein the brush has a cross-track to in-track resolution from about 50×300 to about 300×300 dpi.

21. The method of claim 1 wherein a ribbon printer is used.

22. The method of claim 1 wherein a diffusion process printer is used.

* * * * *